US009127396B2

(12) United States Patent
Yu et al.

(10) Patent No.: US 9,127,396 B2
(45) Date of Patent: Sep. 8, 2015

(54) WASHING MACHINE HAVING A FRICTION SUSPENSION

(75) Inventors: In Sik Yu, Seoul (KR); Young Jong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 180 days.

(21) Appl. No.: 13/823,673

(22) PCT Filed: Aug. 25, 2011

(86) PCT No.: PCT/KR2011/006289

§ 371 (c)(1),
(2), (4) Date: May 28, 2013

(87) PCT Pub. No.: WO2012/036390

PCT Pub. Date: Mar. 22, 2012

(65) Prior Publication Data

US 2013/0247622 A1 Sep. 26, 2013

(30) Foreign Application Priority Data

Sep. 17, 2010 (KR) ..... 10-2010-0091944

(51) Int. Cl.
*D06F 37/20* (2006.01)
*D06F 37/24* (2006.01)
*D06F 37/26* (2006.01)

(52) U.S. Cl.
CPC ..... *D06F 37/203* (2013.01); *D06F 37/24* (2013.01); *D06F 37/268* (2013.01)

(58) Field of Classification Search
CPC ..... D06F 37/20; D06F 37/24; D06F 37/245; D06F 37/203; D06F 37/268
USPC ..... 8/159; 68/23.3, 12.04, 12.06, 140, 23 R, 68/23.1–23.2
See application file for complete search history.

(56) References Cited

U.S. PATENT DOCUMENTS

| | | | | |
|---|---|---|---|---|
| 3,306,082 | A * | 2/1967 | Hasegawa et al. | 68/12.01 |
| 3,744,746 | A * | 7/1973 | Weir et al. | 248/569 |
| 4,934,493 | A * | 6/1990 | Bauer et al. | 188/381 |
| 5,946,946 | A * | 9/1999 | Sharp et al. | 68/23.1 |
| 6,009,730 | A | 1/2000 | Lee | |
| 6,264,014 | B1 * | 7/2001 | Ferlicca | 188/129 |

(Continued)

FOREIGN PATENT DOCUMENTS

| | | | |
|---|---|---|---|
| CN | 1082583 | C | 4/2002 |
| CN | 1519417 | A | 8/2004 |

(Continued)

*Primary Examiner* — Michael Barr
*Assistant Examiner* — Rita Adhlakha
(74) *Attorney, Agent, or Firm* — Birch, Stewart, Kolasch & Birch, LLP

(57) ABSTRACT

A washing machine includes a casing constituting the appearance, a support bar having one end connected to the casing and a suspension for connecting the other end of the support bar to the outer tub so as to suspend the outer tub within the casing, and for absorbing vibrations from the outer tub. The suspension includes an air cap through which the second end of the support bar passes. The air cab is installed on the outer circumference of the outer tub and moves along the support bar according to vibrations from the outer tub. A first friction member fitted on the support bar and disposed within the air cap to contact the inner surface of the air cap. A second friction member contacts the support bar and generates greater frictional force with the support bar than the force generated between the first friction member and the inner surface of the air cap to effectively decrease vibrations.

10 Claims, 6 Drawing Sheets

(56) References Cited

U.S. PATENT DOCUMENTS

| | | | | |
|---|---|---|---|---|
| 6,397,643 | B1 * | 6/2002 | Chang et al. | 68/23.3 |
| 6,474,113 | B1 * | 11/2002 | Park | 68/23.3 |
| 6,591,640 | B2 | 7/2003 | Park | |
| 2004/0144137 | A1 | 7/2004 | Park et al. | |
| 2008/0006062 | A1 * | 1/2008 | Lien et al. | 66/171 |
| 2008/0289368 | A1 * | 11/2008 | Braz et al. | 68/13 R |
| 2009/0031761 | A1 * | 2/2009 | Kim et al. | 68/23.1 |
| 2011/0167878 | A1 * | 7/2011 | De Angelo Sanchez et al. | 68/212 |
| 2011/0247372 | A1 * | 10/2011 | Miller et al. | 68/13 R |
| 2011/0308281 | A1 * | 12/2011 | Yu et al. | 68/212 |
| 2012/0056517 | A1 * | 3/2012 | Noh et al. | 312/228 |

FOREIGN PATENT DOCUMENTS

| | | | |
|---|---|---|---|
| KR | 20-0159471 | Y1 | 10/1999 |
| KR | 2000-0007769 | A | 2/2000 |
| KR | 2001-0036614 | A | 5/2001 |
| KR | 2003-0004712 | A | 1/2003 |

* cited by examiner

WASHING MACHINE HAVING A FRICTION SUSPENSION

TECHNICAL FIELD

The present invention concerns washing machines, and particularly, to washing machines that may effectively reduce vibrations that occur during operation.

BACKGROUND ART

In general, washing machines are appliances that wash laundry using water flow created by rotation of a washing tub or washing wings and impacts exerted by washing wings as well as emulsion actions by detergent. A washing machine proceeds with washing, rinsing, and/or dehydrating processes to get rid of dirt from objects to be washed (hereinafter, referred to as 'laundry') through an action between detergent and water.

A typical washing machine includes a casing forming an outer appearance thereof, an outer tub suspended in the casing, and an inner tub provided to be rotatable in the outer tub. Further, such washing machine includes a suspension to attenuate vibrations that occur to the outer tub when the inner tub and/or a pulsator rotate.

Typically, the suspension is configured to reduce vibrations occurring to the outer tub using elastic/restoring force of a spring and viscous force of a fluid. Such suspension may effectively reduce vibrations in a normal state where the outer tub vibrates within a constant amplitude range, but has a limitation in reducing vibrations in a transient state where the outer tub vibrates at a larger extent than that of the normal vibration state.

In other words, in case a typical suspension is designed to be optimized for the transient vibration state with a larger amplitude, the suspension exhibits a lower vibration attenuation effect in a normal vibration state with a relatively smaller amplitude. On the contrary, in case the suspension is designed to be optimized for the normal vibration state, the suspension may provide a sufficient vibration attenuation effect in the transient vibration state. Accordingly, there is a need for a method of effectively attenuating vibrations in both the normal vibration state and the transient vibration state.

DISCLOSURE

Technical Problem

A first object of the present invention is to provide a washing machine that may effectively reduce vibrations even when the vibration width of the outer tub varies.

A second object of the present invention is to provide a washing machine that may effectively reduce vibrations of the outer tub not only when the vibration width of the outer tub is left in a predetermined range, i.e., in the normal vibration state, but also when the vibration width of the outer tub is left in the transient vibration state where a relatively larger vibration width shows up.

A third object of the present invention is to provide a washing machine with an expanded capacity of outer tub.

A fourth object of the present invention is to provide a washing machine that has enhanced durability and stability and has reduced noise.

Technical Solution

A washing machine according to the present invention comprises a casing forming an outer appearance, a support bar having a first end and a second end, wherein the first end of the support bar is connected to the casing, and a suspension connecting the second end of the support bar with an outer tub so that the outer tub is suspended to an inside of the casing, the suspension mitigating a vibration of the outer tub, wherein the suspension includes an air cap through which the second end of the support bar passes, wherein the air cap is mounted on an outer circumferential surface of the outer tub and moves along the support bar when the outer tub vibrates, a first friction member arranged in the air cap while surrounding the support bar, the first friction member contacting an inner surface of the air cap, and a second friction member arranged to contact the support bar, wherein a frictional force between the second friction member and the support bar is larger than a frictional force between the first friction member and the inner surface of the air cap.

A washing machine according to the present invention comprises a casing forming an outer appearance, a support bar having a first end and a second end, wherein the first end of the support bar is connected the casing, an air cap through which the second end of the support bar passes, wherein the air cap is mounted on an outer circumferential surface of an outer tub and moves along the support bar when the outer tub vibrates, a first friction member relatively moving about an inner surface of the air cap when a vibration width of the outer tub is not more than a predetermined value, and a second friction member sliding along the support bar when the vibration width of the outer tub is not less than the predetermined value.

Advantageous Effects

The washing machine according to the present invention may effectively reduce vibrations of the outer tub by having an attenuation force exerted differently depending on the vibration width of the outer tub.

Further, the washing machine according to the present invention may effectively reduce vibrations in the transient vibration state where the vibration width of the outer tub is relatively larger as well as in the normal vibration state where the vibration width of the outer tub belongs to a predetermined range.

Further, the washing machine according to the present invention may reduce the interval between the casing and the outer tub prepared considering the vibrations of the outer tub and is thus advantageous in expanding the capacity of the outer tub even without increasing the size of the casing.

Further, the washing machine according to the present invention may effectively reduce vibrations of the outer tub, thus enhancing durability and stability and decreasing noise.

BEST MODE

Advantages and features of the present invention and methods for achieving the same become apparent from the embodiments described below in conjunction with the accompanying drawings. However, the present invention is not limited to the embodiments described below, and may be embodied in various forms. The embodiments are provided merely to make the present invention fully disclosed and to completely inform those skilled in the art of the category of the invention. The present invention is defined only by the appended claims. The same reference denotations refer to the same component throughout the specification.

Figure 1:
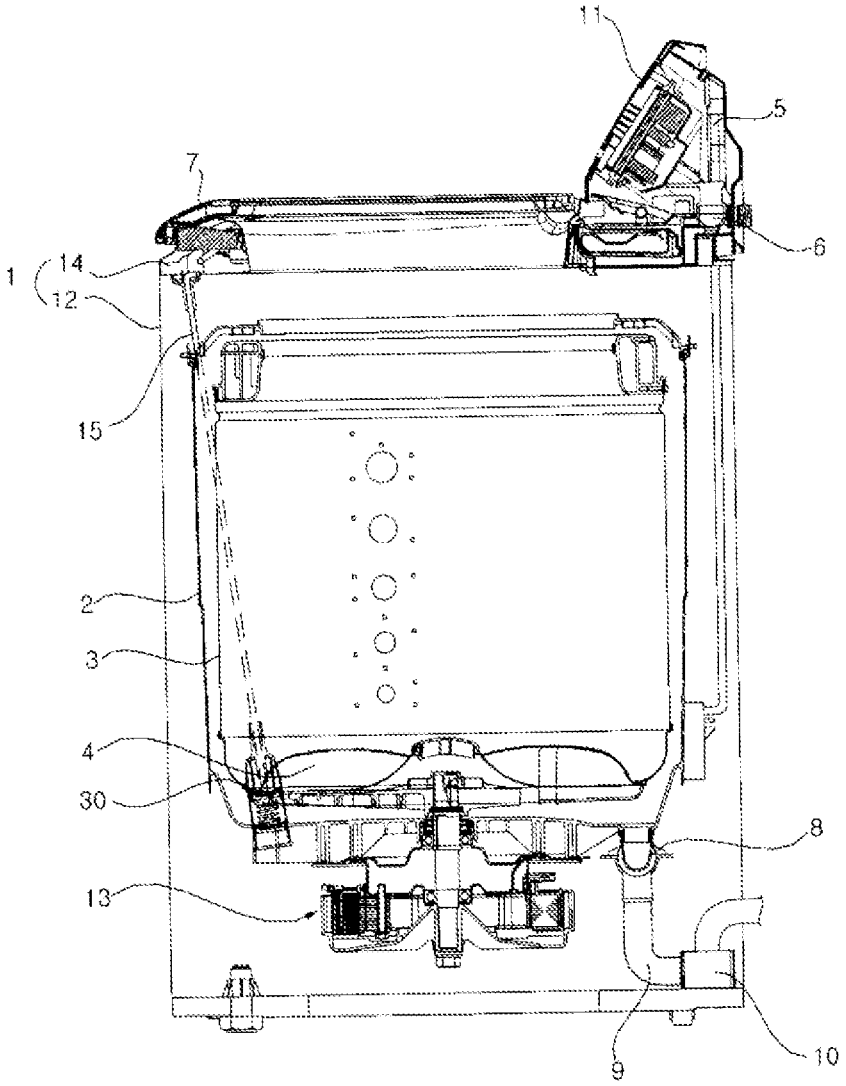
FIG. 1 is a side cross-sectional view illustrating a washing machine according to an embodiment of the present invention, in which the washing machine is cut to disclose main components thereof.
Figure 2:
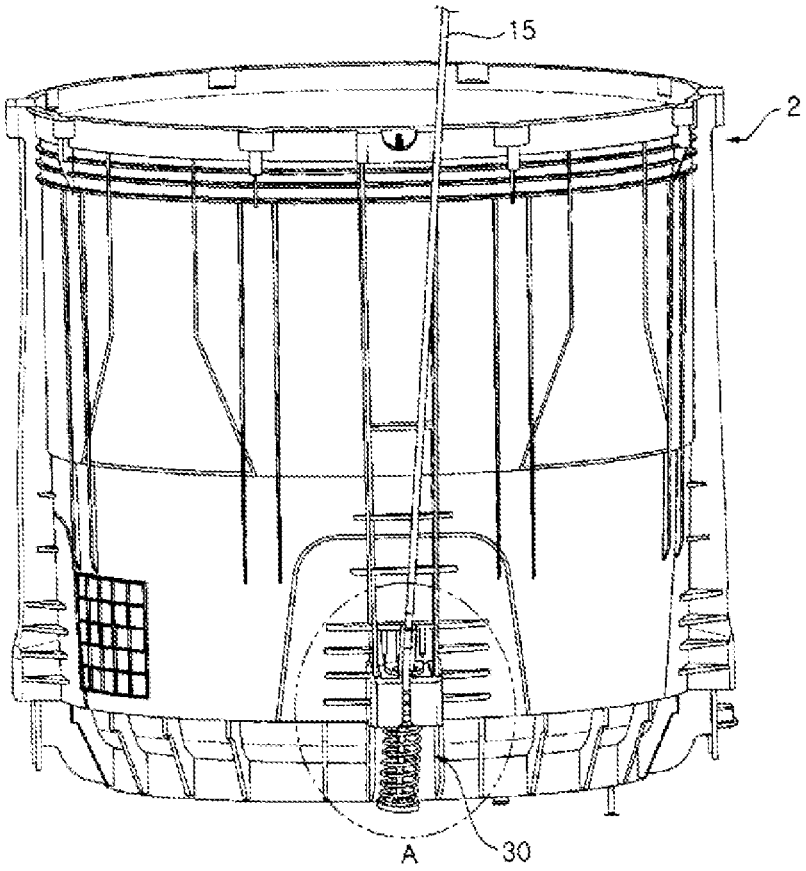
FIG. 2 is a partial perspective view illustrating a configuration of a suspension mounted on the outer tub shown in FIG. 1.
Figure 3:
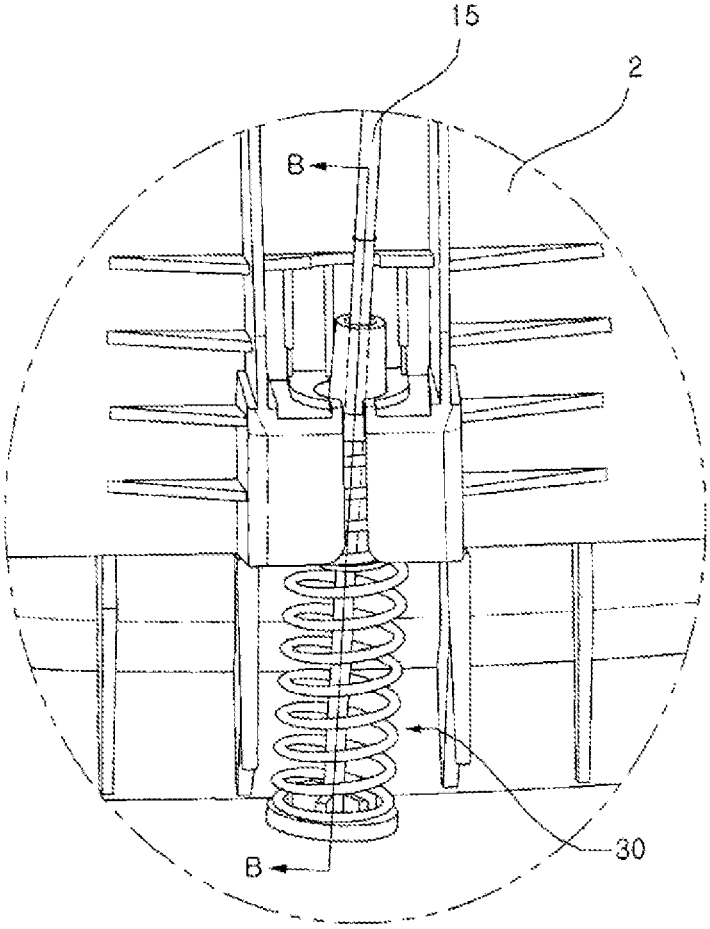
FIG. 3 is a partial expanded view illustrating part A of FIG. 2.
Figure 4:
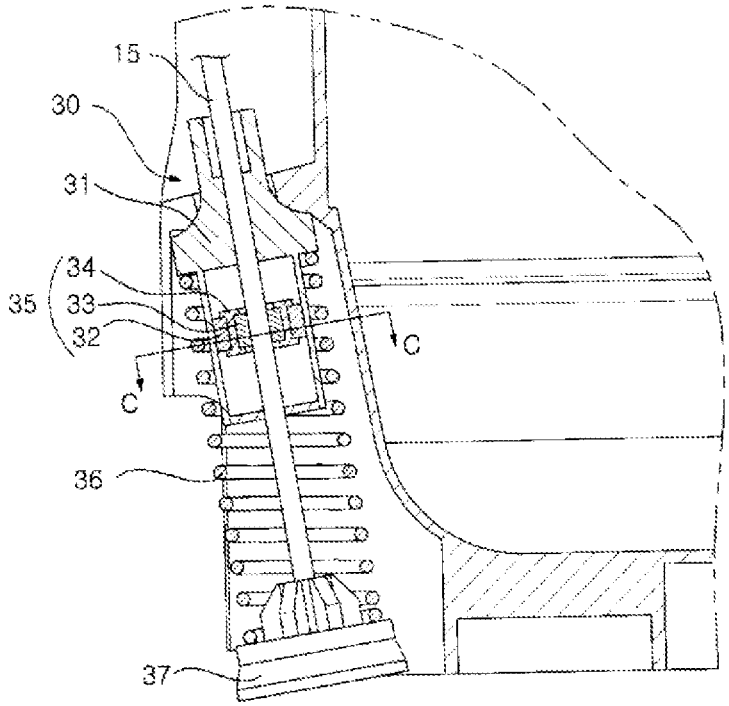
FIG. 4 is a cross-sectional view taken along line B-B of FIG. 3.
Figure 5:
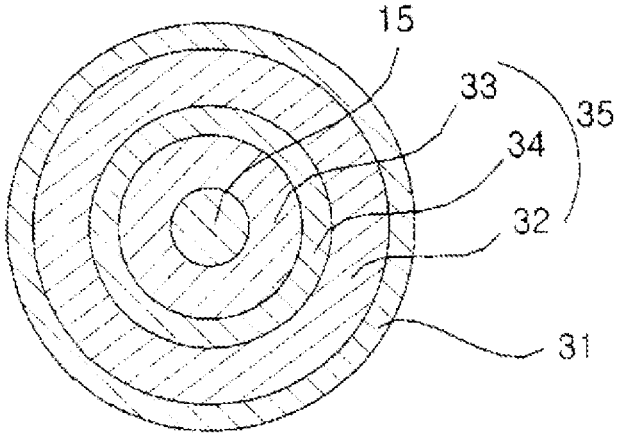
FIG. 5 is a cross-sectional view taken along line C-C of FIG. 4.

FIG. 1 is a side cross-sectional view illustrating a washing machine according to an embodiment of the present invention, in which the washing machine is cut to disclose main components thereof. FIG. 2 is a partial perspective view illustrating a configuration of a suspension mounted on the outer tub shown in FIG. 1. FIG. 3 is a partial expanded view illustrating part A of FIG. 2. FIG. 4 is a cross-sectional view taken along line B-B of FIG. 3. FIG. 5 is a cross-sectional view taken along line C-C of FIG. 4.

Referring to FIGS. 1 to 5, the washing machine according to an embodiment of the present invention includes a casing 1 forming an outer appearance, a control panel 11 that includes manipulation keys for receiving various control commands from a user and a display for displaying information regarding operation states of the washing machine and for providing a user interface, and a door 7 provided to be rotatable with respect to the casing 1 to open and close an enter/exit hole (not shown) through which laundry is entered/exited.

The outer tub 2 in which water is contained is provided to be suspended to the inside of the casing 1 by a support bar 15, and an inner tub 3 is provided to be rotatable in the outer tub 2 to contain water. A pulsator 4 is provided to be rotatable to the bottom of the inner tub 3. The inner tub 3 includes a plurality of holes through which water passes.

The "casing" defined herein may be any casing that forms an outer appearance of the washing machine. In particular, the casing herein is preferably a stationary, fixed rigid body that allows an end of the support bar 15 hanging the outer tub 2 to the inside of the casing to be fixed by the casing. Hereinafter, the casing 1 used herein is merely an example of any structure that forms an outer appearance of the washing machine, and the casing defined in the claims is not necessarily limited thereto.

The casing 1 includes a main body 12 with an upper side opened and a top cover 14 provided at an upper side of the main body 12 and having an enter-and-exit hole substantially at the center thereof, which allows laundry to be entered and exited therethrough. An end of the support bar 15 may be fixed to either the main body 12 or the top cover 14. A supporting means (not shown) may be further provided which allows the support bar 15 to pivot when the outer tub 2 vibrates.

An end of the support bar 15 is connected to the casing 1, and the other end thereof is connected to the outer tub 2 through a suspension 30. The suspension 30 couples the support bar 15 with the outer tub 2 while reducing vibrations of the outer tub 2 which are generated while the washing machine operates.

The suspension 30 includes an air cap 31 that allows the other end of the support bar 15 to be passed therethrough and is fixed to a lower side of the outer circumferential part of the outer tub 2 to interact with the outer tub 2 and a friction mitigating unit 35 that is positioned in the air cap 31 while surrounding the support bar 15 and mitigates vibrations of the outer tub 2 by a frictional force that is generated in association with at least one of the air cap 31 and the support bar 15 as the outer tub 2 vibrates. The friction mitigating unit 35 includes a first friction member 32 contacting an inner surface of the air cap 31 and a second friction member 33 contacting the support bar 15. Here, a frictional force created between the second friction member 33 and the support bar 15 is larger than a frictional force created between the first friction member 32 and the inner surface of the air cap 31.

Also, the friction mitigating unit 35 may further include a friction member receiving member 34 that receives the first friction member 32 and the second friction member 33 and that surrounds the support bar 15 and is positioned in the air cap 31. As shown in FIG. 5, the second friction member 33 in contact with the support bar 15 is received in the inside of the friction member receiving member 34, and the first friction member 32 in contact with the inner surface of the air cap 31 is received in the outside thereof.

The following two methods may render the frictional force between the second friction member 33 and the support bar 15 larger than the frictional force between the first friction member 32 and the inner surface of the air cap 31.

The first method is to make compression rates of the first friction member 32 and the second friction member 33 different from each other, preferably to make the compression rate of the second friction member 33 larger than the compression rate of the first friction member 32. In particular, in case the first friction member 32 and the second friction member 33 are formed of the same material, the second friction member 33 relatively further compressed than the first friction member 32 is received in the inside of the friction member receiving member 34. Here, at least one of the first friction member 32 and the second friction member 33 may be formed to have a fabric structure such as felt.

Applicants have conducted an experiment. Under the conditions that the first friction member 32 and the second friction member 33 are formed of the same material and that the second friction member 33 is compressed at a compression rate of about 30% while the first friction member 32 is not compressed, Applicants measured a frictional force between the first friction member 32 and the inner surface of the air cap 31 (hereinafter, referred to as "first frictional force") in a normal state where the outer tub 2 vibrates with an amplitude of a predetermined magnitude or less and measured a frictional force between the second friction member 33 and the support bar 15 (hereinafter, referred to as "second frictional force") in a transient vibration state where the outer tub 2 vibrates with a predetermined magnitude or more. As a result of the experiment, it could be seen that the second frictional force was about two times or more the first frictional force and accordingly noise occurring in the transient vibration state has been reduced to the considerable level.

To prevent the first friction member 32 from being worn due to friction with the inner surface of the air cap 31 or from being fused due to frictional heat, a slideway oil may be applied to the first friction member 32. Here, the "slideway oil" refers to a fluid used to smooth the operation of sliding surface-contacting mechanisms and is differentiated from lubricating oils. Lubricating oils have high viscosity and adhesive characteristics so as to be able to be long-term used for rotating bodies such as sprockets or gears. In contrast, slideway oils with too high viscosity may interfere with the operation of the mechanisms. Thus, such slideway oils have a lower viscosity than that of lubricating oils, and when used, are applied thin to the mechanisms.

Second, form the first friction member 32 and the second friction member 33 of different materials from each other. The second friction member 33 may be formed of a material better in adhesion force than that of the first friction member 32. Here, the comparison in adhesion force may be made between a force by which the first friction member 32 tightly contacts the inner surface of the 31 and a force by which the second friction member 33 tightly contact the outer circumferential surface of the support bar 15. Meanwhile, considering the case where the first friction member 32 is rendered different in compression rate from the second friction member 33, the second friction member 33 may also be formed of a material lower in adhesion force than that of the first friction member 32.

In the meantime, the suspension 30 may further include an elastic member that is compressed when the downward direction displacement of the air cap 31 is increased by vibration of the outer tub 2. Here, the displacement of the air cap 31 increasing in a downward direction means the case where the outer tub 2 moves in substantially the same direction as the direction of gravity. In such case, gravity as well as an impact force by the vibration is exerted. In particular, when the outer tub 2 is drastically vibrated during, e.g., a period where the rotation speed of the inner tub 3 is sharply increased or a period where the inner tub 3 is rotated at high speed with the laundry unevenly distributed, the downward direction displacement of the air cap 31 exponentially goes up. The elastic member undergoes elastic deformation when the displacement of the air cap 31 increases in the downward direction, thus helping reduce the vibration.

A spring 36, an example of the elastic member, surrounds the support bar 15. The suspension 30 may further include a base 37 that is positioned at the other end of the support bar 15 to support the spring 36. An end of the spring 36 is supported by the base 37 while the other end thereof is restricted by the air cap 31, so that when the downward direction displacement of the air cap 31 increases, the air cap 31 pushes the friction mitigating unit 35 downward, and the spring 36 is thus compressed.

In contrast, when the upward direction displacement of the inner tub 3 increases, the restoring force of the spring 36 is exerted in the direction of pushing up the air cap 31, so that the air cap 31 is operatively brought in tight contact with the outer tub 2. Such structure allows the air cap 31 and the outer tub 2 to interwork ever with each other even without any separate coupling member for fixing the air cap 31 to the outer circumferential surface of the outer tub 2.

Meanwhile, the reference denotations shown in FIG. 1 and configurations thereof are further described. A water supply path 5 is connected to an external water source, e.g., a tab, and supplies water to the outer tub 2 and/or the inner tub 3. A water supply valve 6 switches on/off the water supply path 5. A driver 13 drives the inner tub 3 and/or the pulsator 4. A water discharge path 9 discharges water from the outer tub 2. A water discharge valve 8 switches on/off the water discharge path 9. A water discharge pump 10 pumps water discharged through the water discharge path 9 out of the washing machine.

A process of operating the suspension 30 in the washing machine according to an embodiment of the present invention is now described.

Figure 6:
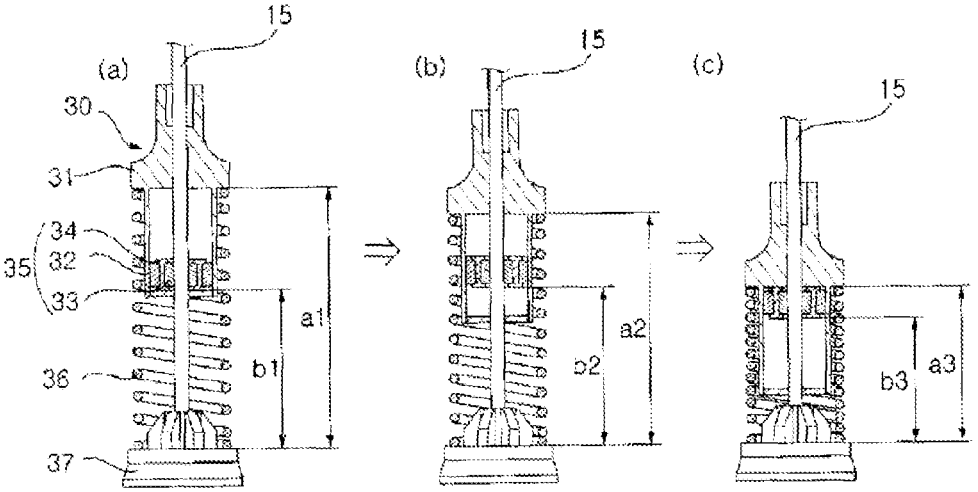
FIG. 6 sequentially illustrates operations of the suspension shown in FIGS. 1 to 4 as the downward direction displacement of the outer tub gradually increases.

FIG. 6 sequentially illustrates operations of the suspension shown in FIGS. 1 to 4 as the downward direction displacement of the outer tub gradually increases. Specifically, (a), (b), and (c) of FIG. 6 sequentially illustrate operations of the suspension 30 when the displacement of the outer tub 2 varies substantially in the direction of gravity.

Referring to (a) and (b) of FIG. 6, while the air cap 31 is gradually shifted downward along the support bar 15 by vibration, the friction mitigating unit 35 does not cause a change in its position over the support bar 15 until the air cap 31 reaches a predetermined travel distance. Comparing FIG. 6(*a*) with FIG. 6(*b*), while the length of the spring 36 is reduced from a1 to a2 due to an increase in the downward direction displacement of the air cap 31, the distance from the base 37 to the friction mitigating unit 35 stays constant (b1=b2). Accordingly, the first friction member 32 relatively moves about the inner circumferential surface of the air cap 31, and a frictional force between the first friction member 32 and the inner circumferential surface of the air cap 31 allows the vibration to weaken.

As shown in (b) of FIG. 6, when the air cap 31 further moves down so that the travel distance of the air cap 31 becomes more than a predetermined distance, the friction mitigating unit 35 is pushed down by the air cap 31, and thus slides along the support bar 15. In such case, the vibration is attenuated by the frictional force between the second friction member 33 and the support bar 15. (c) of FIG. 6 illustrates a state where the friction mitigating unit 35 is pushed down by the air cap 31 (a3<a2, b3<b2).

Figure 7:
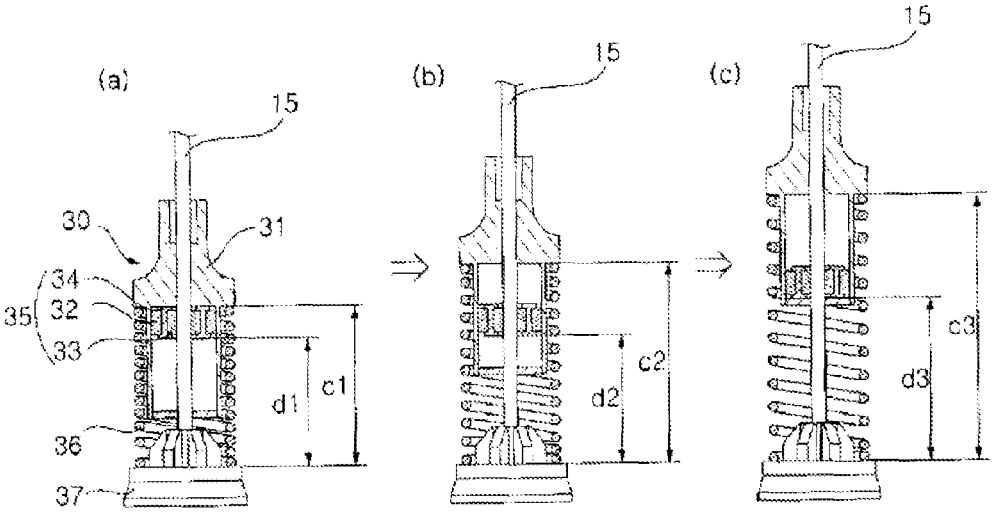
FIG. 7 sequentially illustrates operations of the suspension shown in FIGS. 1 to 4 as the upward direction displacement of the outer tub gradually increases.

FIG. 7 sequentially illustrates operations of the suspension shown in FIGS. 1 to 4 as the upward direction displacement of the outer tub gradually increases. Specifically, (a), (b) and (c) of FIG. 7 sequentially illustrate operations of the suspension 30 when the upward direction vibration increases—in other words, the displacement of the outer tub 2 increases in the substantially opposite direction of gravity—while the outer tub 2 vibrates.

(a) of FIG. 7 shows a state where the downward direction displacement of the outer tub 2 is relatively large so that the spring 36 stays compressed. At this time, the length of the spring 36 is c1, and the distance between the base 37 and the friction mitigating unit 35 is d1.

If the air cap 31 moves up along the support bar 15 in the state shown in (a) of FIG. 7, the friction mitigating unit 35 does not change in position until the travel distance of the air cap 31 reaches a predetermined distance.

(b) of FIG. 7 illustrates a state where the friction mitigating unit 35 remains unchanged (d2=d1) in position while the air cap 31 moves up (c2>c1). In such case, the vibration is reduced by a frictional force between the first friction member 32 and the inner surface of the air cap 31.

(c) of FIG. 7 illustrates a state where the air cap 31 further moves from the position shown in (b) of FIG. 7. The friction mitigating unit 35 is slid upward along the support bar 15 by the air cap 31. In such case, the vibration is mitigated by the frictional force between the second friction member 33 and the support bar 15.

Summarizing what is described above in connection with FIGS. 6 and 7, when the vibration width of the outer tub 2 is not more than a predetermined value, the vibration is reduced by a frictional force between the first friction member 32 and the inner surface of the air cap 31, and when the vibration width of the outer tub 2 is not less than the predetermined value, the second friction member 33 is slid along the support bar 15, so that the vibration is attenuated by a frictional force between the second friction member 33 and the support bar 15.

Before the outer tub 2 reaches a normal state where the outer tub 2 vibrates with a relatively constant amplitude or while the inner tub 3 is not evenly distributed to cause excessive vibration during the dehydration process in which the inner tub 3 rotates at high speed, the vibration is effectively attenuated by a strong frictional force exerted between the second friction member 33 and the support bar 15, and stability may be thus secured. Further, the outer tub 2 may be back to the normal state within a short time. In the normal state where the outer tub 2 vibrates with a relatively constant amplitude, a frictional force between the first friction member 32 and the inner surface of the air cap 31 may reduce the vibration and may significantly decrease noise.

It will be understood by those skilled in the art that the present invention may be embodied in various forms without departing from the scope or spirit of the invention. Thus, the above-described embodiments should not be interpreted as limiting the invention. Rather, the scope of the invention is defined only by the appended claims, and all possible modifications or alterations that may be made thereto from the scope of the invention and its equivalents should be interpreted as included in the scope of the invention

The invention claimed is:

1. A washing machine comprising:

a casing forming an outer appearance;

an outer tub disposed in the casing;

a support bar hanging the outer tub in the casing, the support bar having a first end and a second end, wherein the first end of the support bar is connected to the casing; and a suspension mitigating vibration of the outer tub, the suspension comprising:

a base provided at the second end of the support bar;

a unit frictionally dampening vibration of the outer tub, the unit fitted about the support bar;

a support member supporting the outer tub, the support bar passing through the support member, the support member including a support portion on which the outer tub is seated and a housing portion forming a space for receiving the unit, the space having an upper surface and lower surface; and a spring arranged about the support bar, wherein the spring is seated on the base and supports the support portion, wherein the housing portion extends downwardly from the support portion and inside the spring, and wherein the unit comprises:

a friction member receiving member arranged between the support bar and the housing portion;

a first friction member seated on an outer surface of the friction member receiving member, the first friction member contacting an inner surface of the housing; and a second friction member seated on an inner surface of the friction member receiving member, the second friction member contacting the support bar, wherein a frictional force between the second friction member and the support bar is larger than a frictional force between the first friction member and the inner surface of the housing portion.

2. The washing machine of claim 1, wherein the first and second friction members have compression rates different from each other.

3. The washing machine of claim 1, wherein the first and second friction members are formed of the same material, and wherein a compression rate of the second friction member is larger than a compression rate of the first friction member.

4. The washing machine of claim 1, wherein the first and second friction members are formed of materials different from each other.

5. The washing machine of claim 4, wherein the second friction member is larger in adhesion force than the first friction member.

6. The washing machine of claim 1, wherein at least one of the first and second friction members is formed to have a fabric structure.

7. The washing machine of claim 6, wherein a slideway oil is applied on at least one of the first and second friction members.

8. The washing machine of claim 1, wherein the spring is compressed when a downward direction displacement of the support member is increased.

9. The washing machine of claim 1, wherein the unit remains stationary when a vibration width of the outer tub is not more than a predetermined value and slides along the support bar when the vibration width of the outer tub is not less than the predetermined value.

10. The washing machine of claim 9, wherein the unit is moved downwardly by a contact with the lower surface of the housing portion and moves upwardly by a contact with the upper surface of the housing portion when the vibration width of the outer tub is not less than the predetermined value.

* * * * *